US007460809B2

(12) United States Patent
Shirakata et al.

(10) Patent No.: US 7,460,809 B2
(45) Date of Patent: Dec. 2, 2008

(54) AIR PROCESSING APPARATUS AND IMAGE FORMING SYSTEM

(75) Inventors: Jiro Shirakata, Kashiwa (JP); Toshiyuki Nagano, Kawasaki (JP); Hideki Mori, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 165 days.

(21) Appl. No.: 11/480,488

(22) Filed: Jul. 5, 2006

(65) Prior Publication Data

US 2007/0009283 A1 Jan. 11, 2007

(30) Foreign Application Priority Data

Jul. 6, 2005 (JP) ..... 2005-197629

(51) Int. Cl.
*G03G 21/00* (2006.01)
*G03G 21/20* (2006.01)

(52) U.S. Cl. ..... 399/92; 399/1; 399/107

(58) Field of Classification Search ..... 399/91, 399/92, 93, 94, 107, 1, 16
See application file for complete search history.

(56) References Cited

U.S. PATENT DOCUMENTS 5,708,938 A * 1/1998 Takeuchi et al. ..... 399/250
5,819,137 A * 10/1998 Hoffman et al. ..... 399/93
6,297,886 B1 * 10/2001 Cornell ..... 399/16 X
6,334,033 B1 * 12/2001 Ayash et al. ..... 399/91
6,621,554 B1 * 9/2003 Ayash et al. ..... 399/94 X
2005/0180772 A1 * 8/2005 Dergham et al. ..... 399/92
2006/0093394 A1 5/2006 Shirakata ..... 399/93

FOREIGN PATENT DOCUMENTS

JP 01-276156 A * 11/1989
JP 03-238461 A * 10/1991
JP 09-274393 A * 10/1997
JP 10-186813 7/1998
JP 2003-140514 5/2003

* cited by examiner

*Primary Examiner*—Sophia S Chen
(74) *Attorney, Agent, or Firm*—Fitzpatrick, Cella, Harper & Scinto

(57) ABSTRACT

An air processing apparatus is provided with an air processing apparatus main body, to which a plurality of office apparatuses are connectable. A suction air interface for connecting the office apparatuses and the air processing apparatus main body together is provided so that air in the office apparatuses can be received into the air processing apparatus main body. An air processing portion is also provided in the air processing apparatus main body, to process the air received into the air processing apparatus main body through the suction air interface.

17 Claims, 11 Drawing Sheets

AIR PROCESSING APPARATUS AND IMAGE FORMING SYSTEM

This application claims priority from Japanese Patent Application No. 2005-197629, filed Jul. 6, 2005, which is hereby incorporated by reference herein.

BACKGROUND OF THE INVENTION

1. Field of the Invention

The invention relates to an air processing apparatus for receiving air in an office apparatus and subjecting the air to processing, and an image forming system having an image forming apparatus and the air processing apparatus.

2. Description of the Related Art

Among image forming apparatuses, which are a type of office apparatus, there are ones of a type adapted to exhaust air in the apparatus, to draw air in from outside while cleaning the air, and to keep the environment in the apparatus in an optimum state (Japanese Patent Application Laid-open No. 2003-140514 and Japanese Patent Application Laid-open No. H10-186813).

The image forming apparatus forms an image on a sheet. Also, the office apparatuses include, besides the image forming apparatus, an image reading apparatus, a recording paper feeding apparatus, a recording paper conveying apparatus, a sheet processing apparatus and an information input and output apparatus. The image reading apparatus reads an original. The recording paper feeding apparatus feeds recording paper (a sheet) into the image forming apparatus or the sheet processing apparatus. The recording paper conveying apparatus conveys the recording paper from a certain apparatus (e.g., a recording paper feeding apparatus) to other apparatus (e.g., the image forming apparatus). The sheet processing apparatus carries out at least one of the processes of punching a sheet or a bundle of sheets, closing the bundle of sheets, and folding the sheet or the bundle of sheets. As the information input and output apparatus, there is a large image scanner, a document server, or the like.

FIG. 10 of the accompanying drawings shows the image forming apparatus described in Japanese Patent Application Laid-open No. 2003-140514. This image forming apparatus 501 is provided with an ozone filter 502 for processing ozone generated in the apparatus and an exhaust fan 503 in the upper portion of a heat fixing device 504, and removes the ozone in the air in the apparatus and discharges the air.

FIG. 11 of the accompanying drawings shows the image forming apparatus described in Japanese Patent Application Laid-open No. H10-186813. This image forming apparatus 511 directs the air outside the apparatus to a primary charging corona charger 514 through a dust collection corona charger 512 and a filter 513 to thereby clean the primary charging corona charger 514.

Also, besides the image forming apparatus, in various information input and output apparatuses used in offices, such as, for example, a large image scanner and a document server, air intake into the apparatus for cooling and exhaust to the outside of the machine are effected.

As described above, the office apparatuses including the image forming apparatuses and various information input and output apparatuses used at present in offices individually effect the giving and receiving of the air, such as exhaust and intake between the interior of the apparatus and the exterior of the apparatus.

Also, the image forming apparatuses described in Japanese Patent Application Laid-open No. 2003-140514 and Japanese Patent Application Laid-open No. H10-186813 effect the processing of exhaust, the cleaning of intake air, etc., independently of one another by individual apparatuses. Therefore, for example, filters, or the like, used for the processing of the exhaust need to be subjected to maintenance in the individual apparatuses, and in an office provided with a plurality of office apparatuses, there has been the problem that the maintenance work for these office apparatuses becomes cumbersome.

SUMMARY OF THE INVENTION

The present invention has as its object to provide an air processing apparatus for collectively effecting the processing of air in a plurality of office apparatuses.

The air processing apparatus of the present invention is provided with an air processing apparatus main body to which a plurality of office apparatuses are connectable, a suction air interface for connecting the plurality of office apparatuses and the air processing apparatus main body together, so as to be capable of receiving air in the plurality of office apparatuses into the air processing apparatus main body, and air processing means provided in the air processing apparatus main body for effecting processing on the air received into the air processing apparatus main body through the suction air interface.

The air processing apparatus of the present invention receives the air in the plurality of office apparatuses into the air processing apparatus main body through the suction air interface, and effects air processing by the air processing means. It can collectively effect the processing of the air in the plurality of office apparatuses connected to the air processing apparatus, and achieves the effect that the maintenance of the air processing means becomes easy. Also, it can improve the comfort level.

DESCRIPTION OF THE PREFERRED EMBODIMENTS

Air processing apparatuses according to some embodiments of the present invention will hereinafter be described with reference to the drawings.

Figure 3:
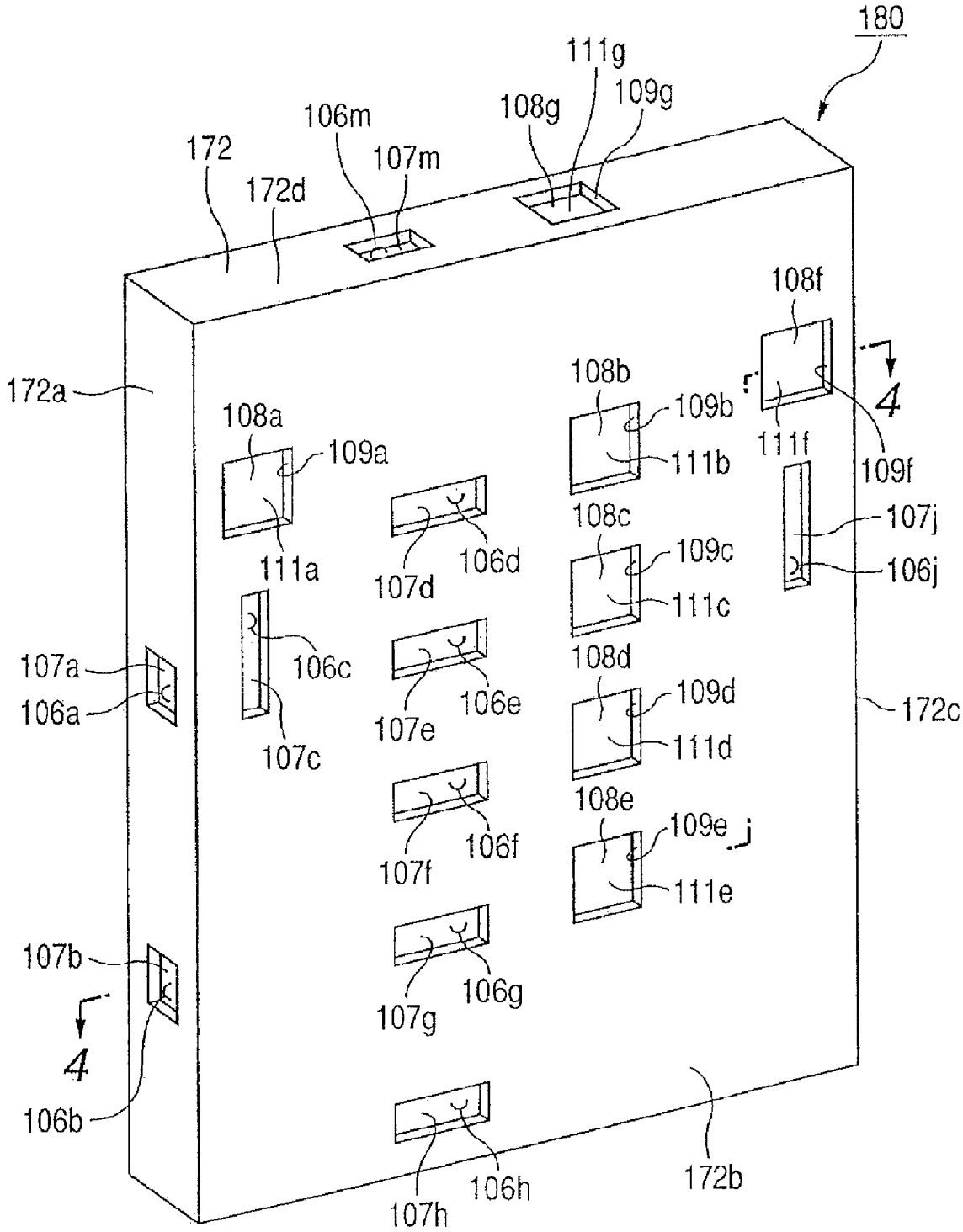
FIG. 3 is a pictorial perspective view of the air processing apparatus according to the first embodiment.
Figure 4:
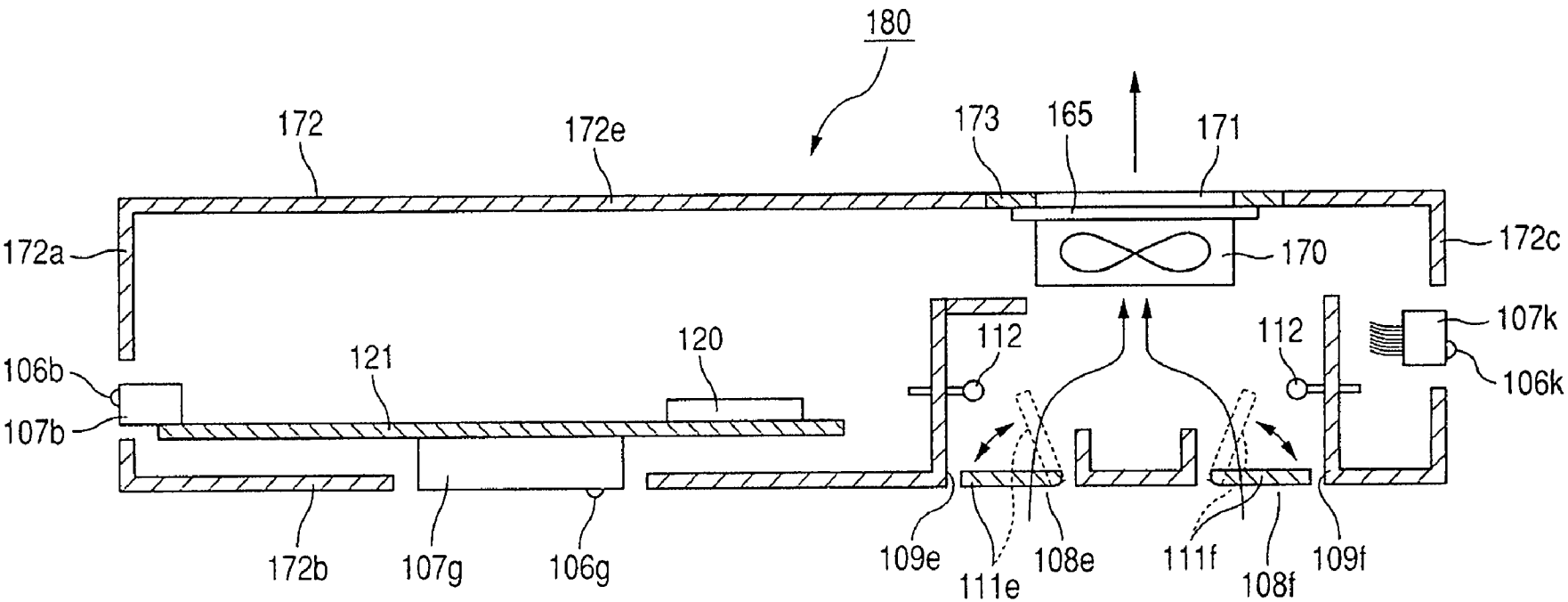
FIG. 4 is a cross-sectional view taken along the line 4-4 of FIG. 3.
Figure 5:
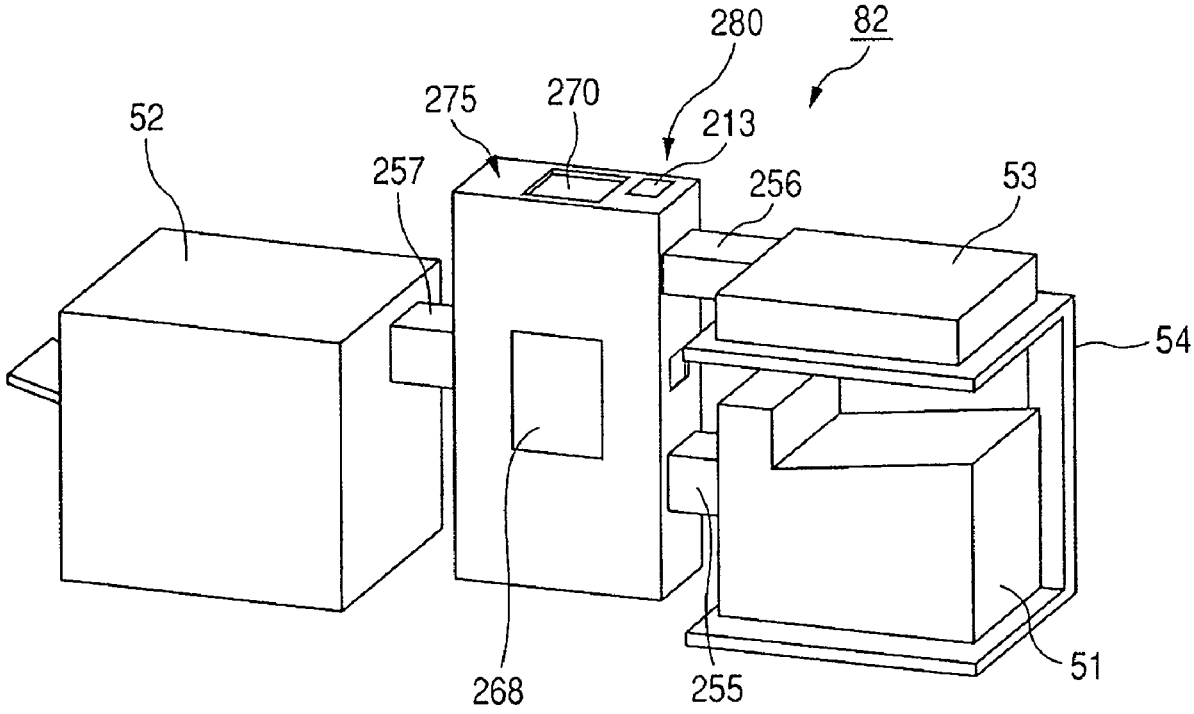
FIG. 5 is a pictorial perspective view of an image forming system formed by a color printer, a monochromatic printer and an image reading apparatus disposed on a placement stand being connected to an air processing apparatus according to a second embodiment of the present invention.
Figure 6:
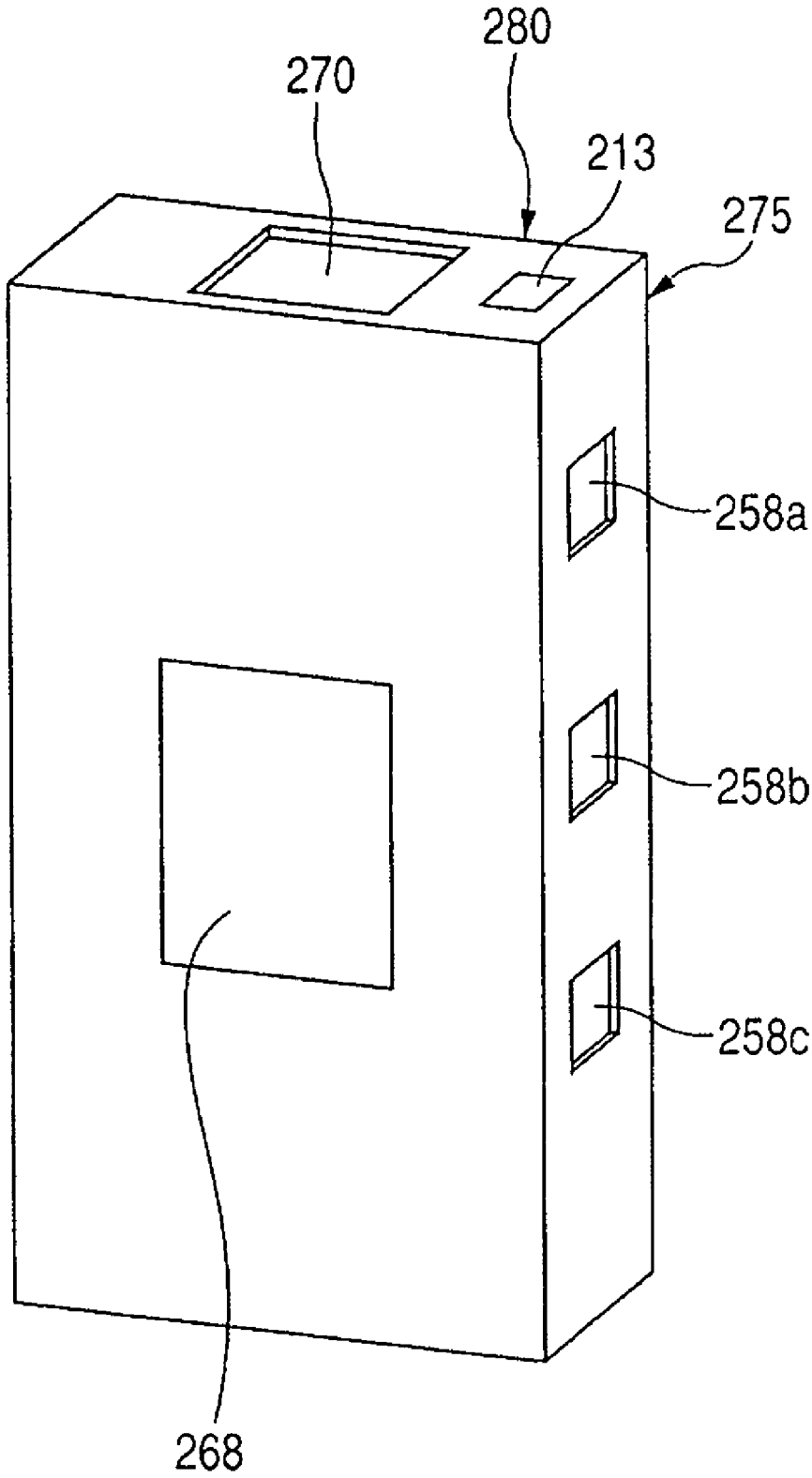
FIG. 6 is a pictorial perspective view of the air processing apparatus according to the second embodiment of the present invention.
Figure 7:
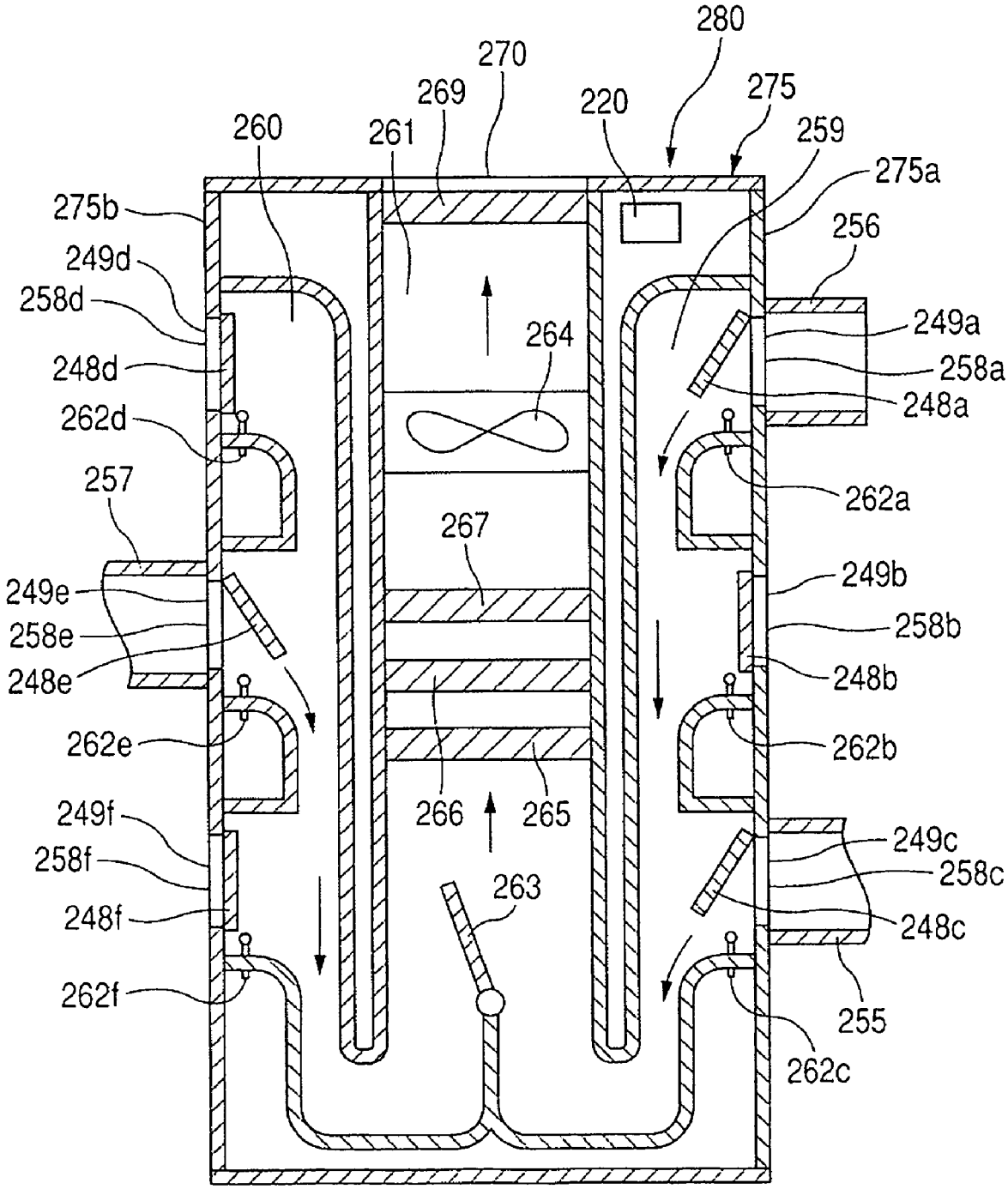
FIG. 7 is a schematic front cross-sectional view of the air processing apparatus of FIG. 6.

An air processing apparatus 180, according to a first embodiment shown in FIGS. 1 to 4, and an air processing apparatus 280, according to a second embodiment shown in FIGS. 5 to 7, are adapted to collectively clean air in a plurality of office apparatuses and then exhaust it. Also, an air processing apparatus 380, according to a third embodiment shown in FIGS. 8 and 9, is adapted to collectively subject air in a plurality of office apparatuses to a cleaning process and a heat radiating process, and then feeding it again into the office apparatuses and circulating and using the air.

The office apparatuses are common apparatuses connected to the air processing apparatuses according to the respective embodiments and, therefore, will be collectively described before the description of the air processing apparatuses 180, 280 and 380.

The office apparatuses include an image reading apparatus 53, a color printer 51 and a monochromatic printer 52 as image forming apparatuses, and paper decks 73 and 74 as recording paper feeding apparatuses, and further include side panels 103 and 104 as recording paper conveying apparatuses, a post-processing apparatus 72 as a sheet processing apparatus, and an information input and output apparatus (not shown). The internal structure of these apparatuses need not be described.

Figure 1:
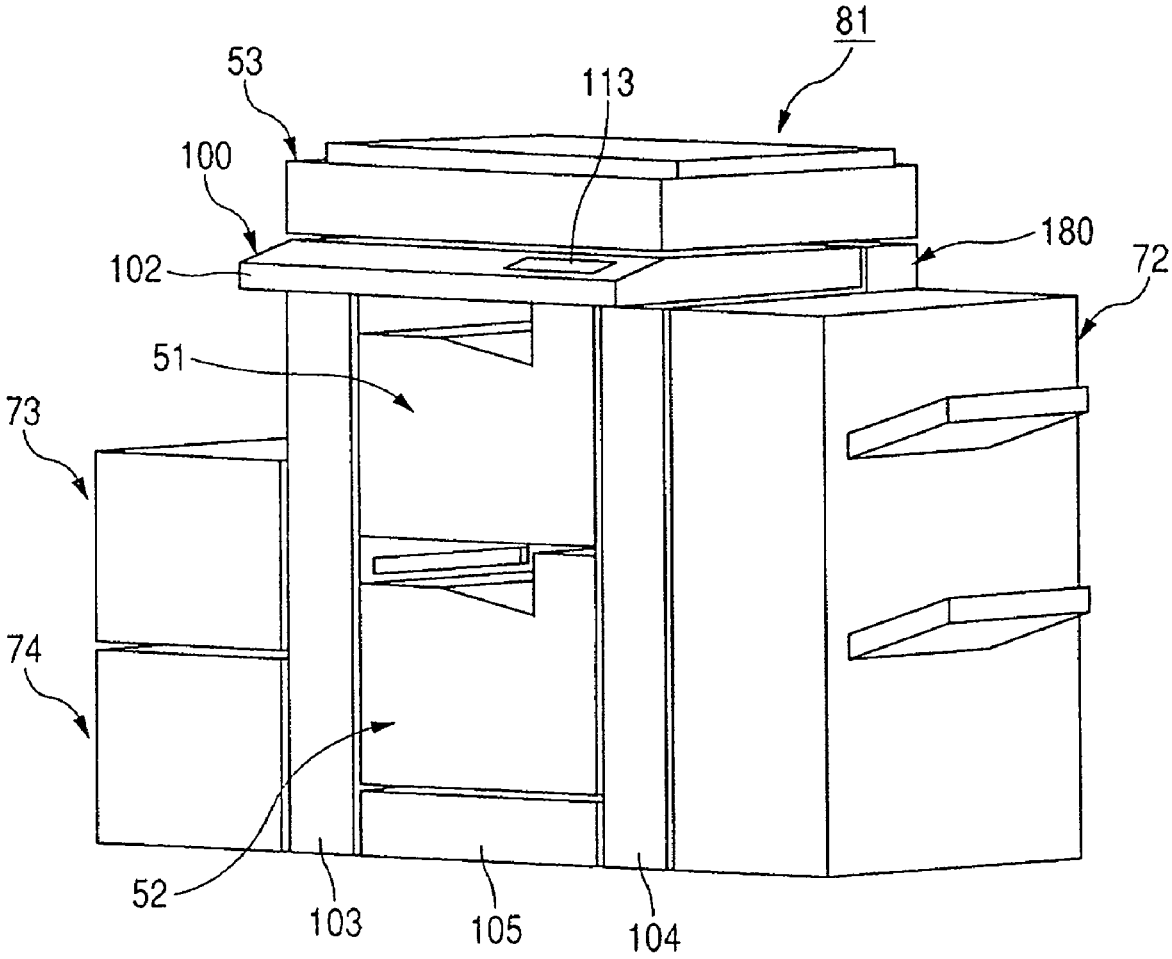
FIG. 1 is a pictorial perspective view of an image forming system formed by a paper deck, a color printer, a monochromatic printer and a post-processing apparatus being connected to a base unit having an air processing apparatus according to a first embodiment of the present invention.
Figure 8:
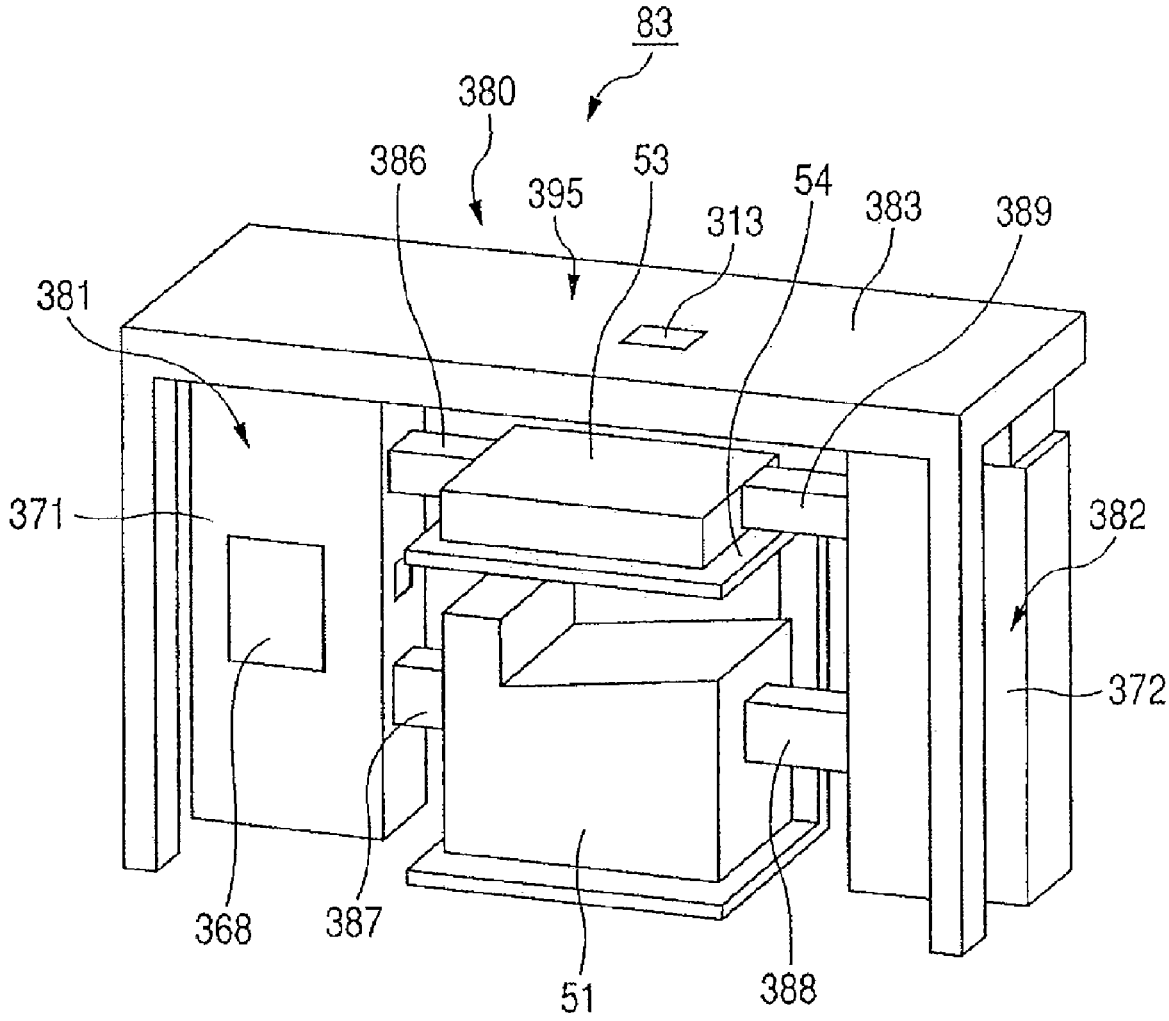
FIG. 8 is a pictorial perspective view of an image forming system formed by a color printer of an electrophotographic printing type and an image forming apparatus disposed on a placement stand being connected to an air processing apparatus, according to a third embodiment of the present invention.
Figure 9:
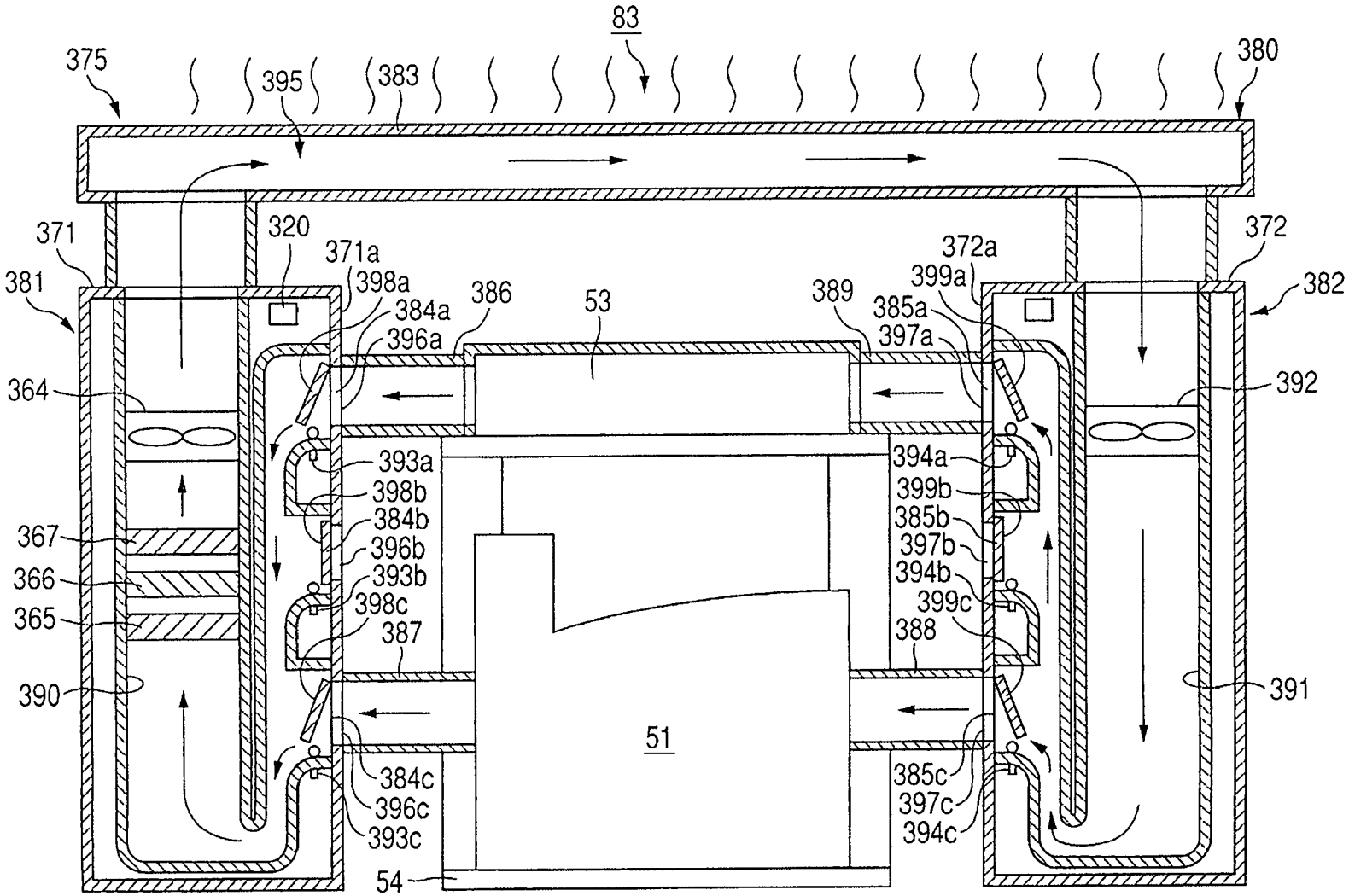
FIG. 9 is a schematic front cross-sectional view of the image forming system of FIG. 8.
Figure 10:
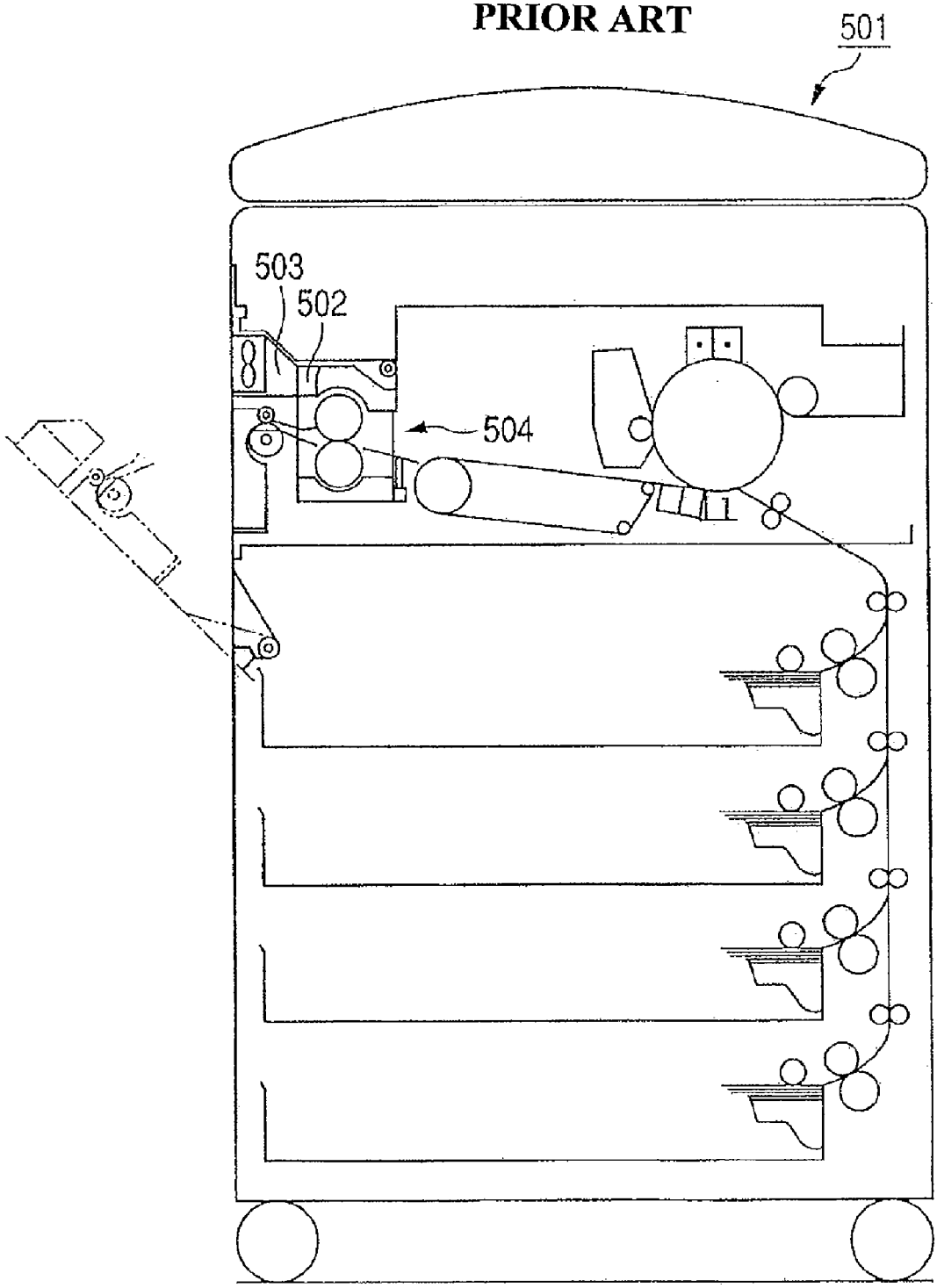
FIG. 10 PRIOR ART
FIG. 10 is a schematic front cross-sectional view of a conventional image forming apparatus provided with an ozone filter for processing ozone.
Figure 11:
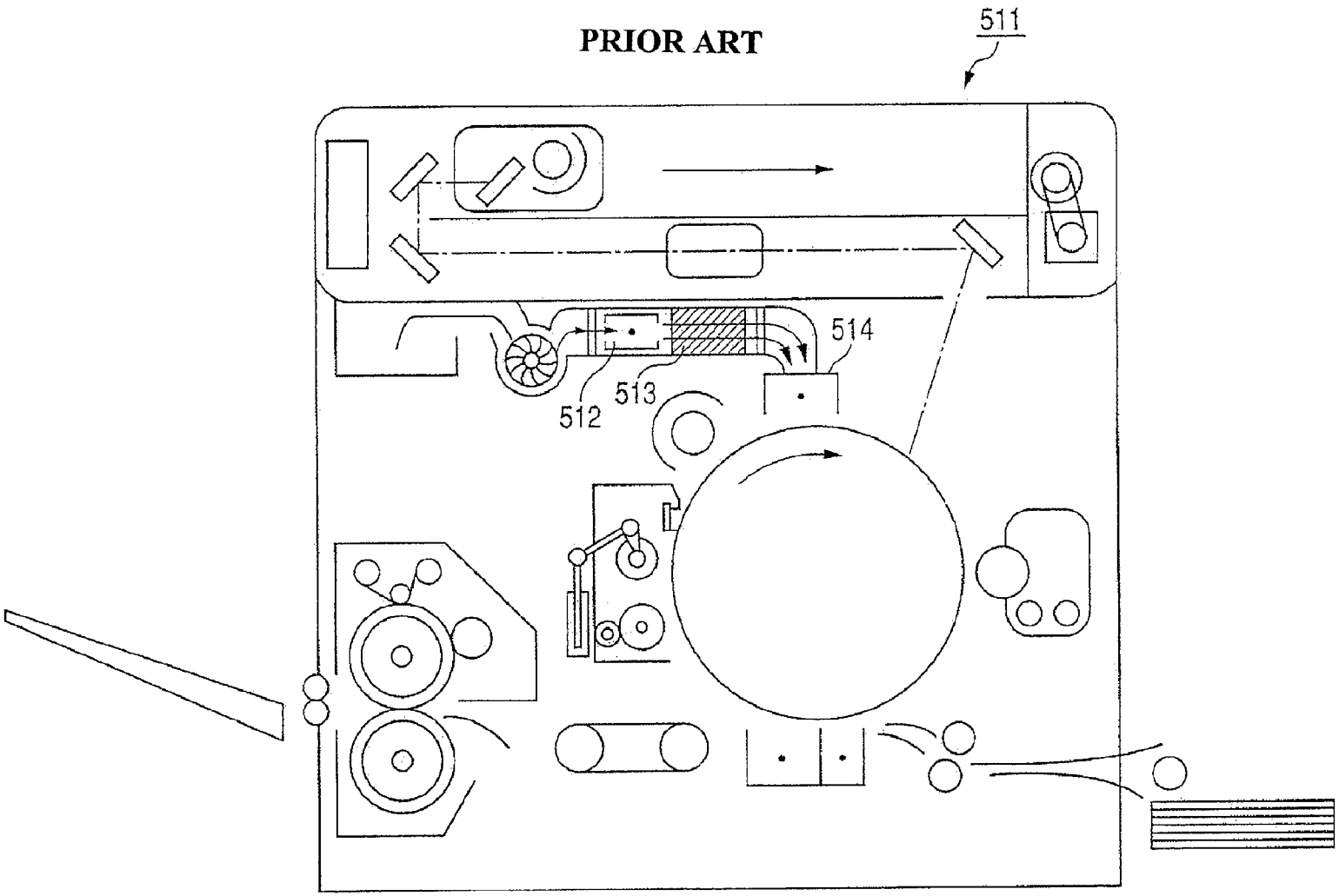
FIG. 11 PRIOR ART
FIG. 11 is a schematic front cross-sectional view of a conventional image forming apparatus provided with a dust collection corona charger and a filter.

The image reading apparatus 53, shown in FIGS. 1, 5 and 8, reads the image of an original at a high speed. The color printer 51, shown in FIGS. 1, 5 and 8, forms a color image on a sheet with color toners by an electrophotographic printing method. The monochromatic printer 52 is also adapted to form a monochromatic image on a sheet with a black toner at a high speed by the electrophotographic printing method. The color printer 51 and the monochromatic printer 52 form a toner image on the sheet on the basis of an image reading signal based on the image of an original read by the image reading apparatus 53, or an image signal sent from other information apparatus, such as a personal computer or other printer.

The paper decks 73 and 74, shown in FIG. 1, contain sheets of different sizes therein. The paper decks 73 and 74 feed the sheets contained therein to the color printer 51 or the monochromatic printer 52, which is an image forming apparatus. The paper decks 73 and 74 selectively feed sheets (recording paper), an operator has selected by external instructions, to the color printer 51 and the monochromatic printer 52 through a side panel 103. The paper decks 73 and 74 may be designed to directly feed the sheets into the color printer 51 and the monochromatic printer 52 without the intermediary of the side panel 103.

Figure 2:
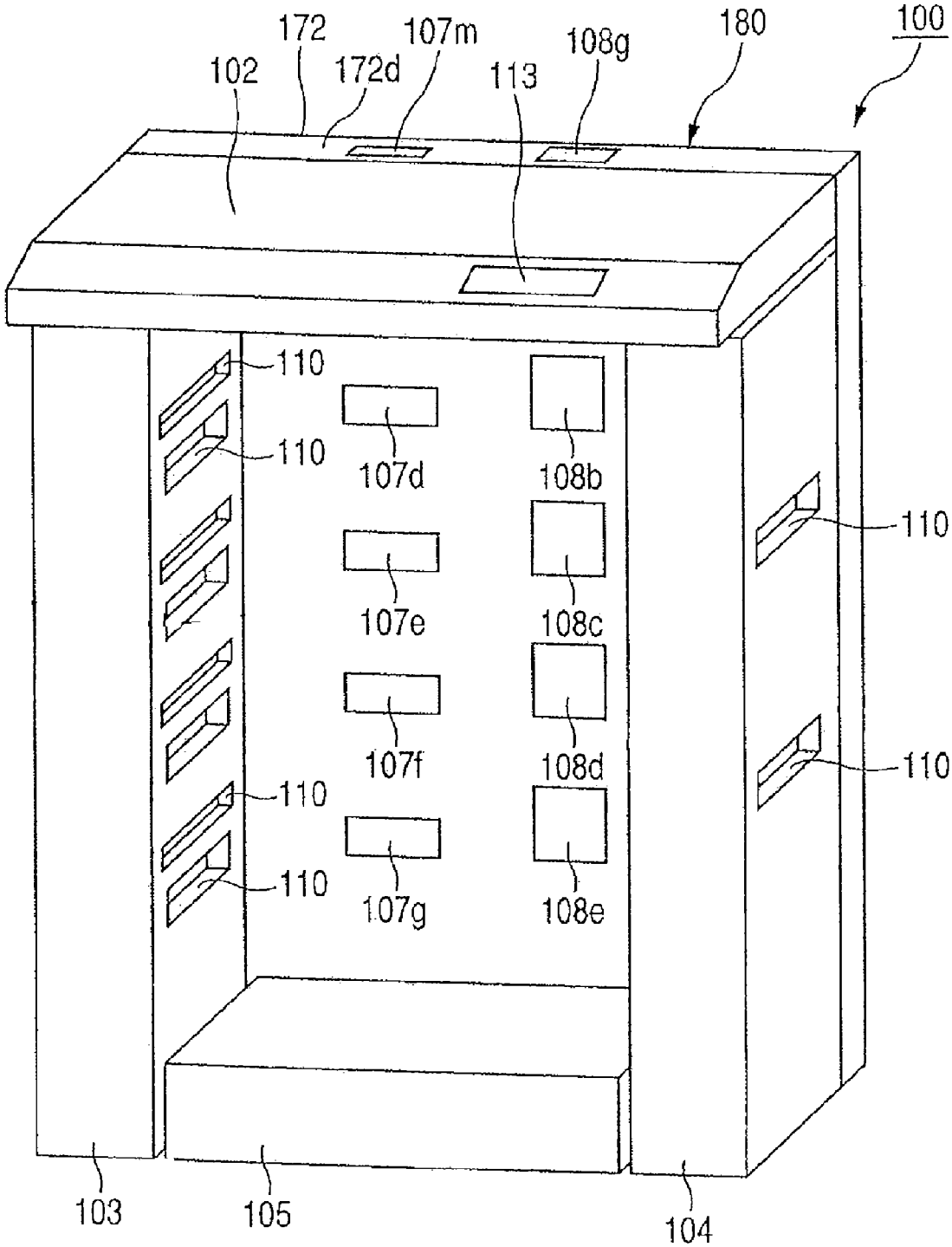
FIG. 2 is a pictorial perspective view of the base unit having the air processing apparatus according to the first embodiment.

The side panel 103, shown in FIGS. 1 and 2, sends the sheets fed out from the paper decks 73 and 74 to the color printer 51 and the monochromatic printer 52. The side panel 104 sends the sheets sent out from the color printer 51 and the monochromatic printer 52 to the post-processing apparatus 72.

The post-processing apparatus 72 carries out at least one of the process of directly punching the sheet sent from the side panel 104 or making the sheets into a bundle and punching the bundle, the process of binding the sheet bundle, the process of folding the sheet or the sheet bundle, and the process of effecting pasting on a side edge of the sheet bundle to thereby bind the sheet bundle. The post-processing apparatus can also receive the sheets directly from the color printer 51 and the monochromatic printer 52 without the intermediary of the side panel 104.

The color printer 51, the monochromatic printer 52, the paper decks 73, 74, the image reading apparatus 53 and the post-processing apparatus 72 are directly or indirectly detachably mountable with respect to the air processing apparatus 180. The paper decks 73, 74, the image reading apparatus 53 and the post-processing apparatus 72 are increasingly optional apparatuses. That is, necessary ones of the paper decks 73, 74, the image reading apparatus 53 and the post-processing apparatus 72 are selected, so as to constitute an image forming system according to a necessity of the user, whereby the image forming system is constituted.

As the information input and output apparatus (not shown), there is a large image scanner, a document server, or the like. The image forming apparatus forms an image on a sheet.

(Air Processing Apparatus According to the First Embodiment)

The air processing apparatus according to the first embodiment of the present invention will hereinafter be described with reference to FIGS. 1 to 4.

FIG. 1 is a pictorial perspective view of an image forming system 81. The image forming system 81 is constituted by the paper decks 73, 74, the color printer 51, the high-speed monochromatic printer 52 and the post-processing apparatus 72 being connected to a base unit 100 having the air processing apparatus 180. The paper decks 73, 74, the color printer 51, the high-speed monochromatic printer 52 and the post-processing apparatus 72 are detachably connected to the base unit 100 having the air processing apparatus 180. FIG. 2 is a pictorial perspective view of the base unit 100. FIG. 3 is a pictorial perspective view of the air processing apparatus 180. FIG. 4 is a cross-sectional view taken along the line 4-4 of FIG. 3.

The base unit 100 is formed by a top surface panel 102, the side panels 103, 104 and an underside panel 105 being connected to the air processing apparatus 180.

The top surface panel 102 is provided with an operating panel 113 for operating the image forming system 81, inputting operation information, and displaying the operative state of the image forming system 81.

The left and right side panels 103 and 104 are formed with a plurality of sheet carrying-in holes (not shown) for receiving sheets conveyed from the office apparatus on the left side of the side panels 103 and 104, and a plurality of sheet carrying-out holes 110 for delivering the sheets carried in from the sheet carrying-in holes to the office apparatus on the right side of the side panels 103 and 104. The sheet carrying-in holes (not shown) are formed in the left side portions of the side panels 103 and 104. The underside panel 105 has a horizontal conveying path (not shown) for conveying the sheets from the paper decks 73 and 74 to the post-processing apparatus 72.

The housing 172 of the air processing apparatus 180 has connected thereto the color printer 51, the monochromatic printer 52, the post-processing apparatus 72, the paper decks 73, 74 and the high-speed image reading apparatus 53. The air processing apparatus 180 has a controller 120 (see FIG. 4) as a control portion for electrically intensively controlling the office apparatuses 73, 74, 103, 51, 52, 104, 72, 53 and 105 connected to the air processing apparatus 180 and the air processing apparatus 180 itself. The controller 120 is provided in the interior of the housing 172 through a substrate 121. A controller may be provided for each office apparatus so that the controller 120 may effect the giving and receiving of a signal with the controller of each office apparatus, and may control only the air processing apparatus 180.

Also, electrical signal interfaces (hereinafter simply referred to as the "interfaces") 107*a* to 107*h*, 107*j* and 107*m* are provided in the housing 172 constituting an air processing apparatus main body, shown in FIGS. 3 and 4, through the substrate 121 (see FIG. 4). Also, an interface 107*k* (see FIG. 4) is provided in the housing through another substrate (not shown). The interfaces 107*a* to 107*h*, 107*j*, 107*k* and 107*m* effect the giving and receiving of an electrical signal between the controller 120 and each office apparatus and also, connect each office apparatus to a power source (not shown).

The interfaces 107*a* and 107*b* provided on the left side portion 172*a* of the housing 172 are connected to the paper decks 73 and 74, respectively. The paper decks 73 and 74 are connected to the left side portion 172*a* of the housing 172.

The interface 107*c*, provided on the front portion 172*b* of the housing 172, is adapted to be connected to the side panel 103, the interfaces 107*d* and 107*e* are adapted to be connected to the color printer 51, the interfaces 107*f* and 107*g* are adapted to be connected to the monochromatic printer 52, the interface 107*h* is adapted to be connected to the underside panel 105, and the interface 107*j* is adapted to be connected to the side panel 104.

The interface 107*k*, provided on the right side portion 172*c* of the housing 172, is adapted to be connected to the post-processing apparatus 72. The interface 107*m*, provided on the upper portion 172*d* of the housing 172, is adapted to be connected to the image reading apparatus 53.

The interfaces 107*a* to 107*h*, 107*j*, 107*k* and 107*m* are provided with connection detecting sensors 106*a* to 106*h*, 106*j*, 106*k* and 106*m*, respectively, as suction connection detecting means. These connection detecting sensors are adapted to detect whether the office apparatuses 73, 74, 103, 51, 52, 104, 72, 53 and 105 are connected.

The housing 172 has an exhaust fan (suction fan) 170 (see FIG. 4) as suction means for drawing in and discharging the air in the office apparatuses 73, 74, 103, 51, 52, 104, 72, 53 and 105 connected to the housing 172. The housing 172 is provided with intake variable openings 108*a* to 108*g* as suction air interfaces. The intake variable openings 108*a* to 108*g* are adapted to be connected to the exhaust ports of the office apparatuses 73, 74, 103, 51, 52, 104, 72, 53 and 105. The air in the office apparatuses 73, 74, 103, 51, 52, 104, 72, 53 and 105 is adapted to be drawn into the housing 172 by the suction of the exhaust fan 170 through the intake variable openings 108*a* to 108*g*. That is, the intake variable openings 108*a* to 108*g* connect the office apparatuses 73, 74, 103, 51, 52, 104, 72, 53 and 105 to the housing 172 so that the air in the office apparatuses 73, 74, 103, 51, 52, 104, 72, 53 and 105 can be received into the housing 172. The intake variable openings 108*a* to 108*g* are adapted to be capable of adjusting the opening amounts thereof.

The intake variable opening 108*a*, provided in the fore portion 172*b* of the housing 172, is adapted to be connected to the side panel 103, the intake variable openings 108*b* and 108*c* are adapted to be connected to the color printer 51, the intake variable openings 108*d* and 108*e* are adapted to be connected to the monochromatic printer 51, and the intake variable opening 108*f* is adapted to be connected to the side panel 104. The intake variable opening 108*g*, provided in the upper portion 172*d* of the housing 172, is adapted to be connected to the image reading apparatus 53. The kinds of the office apparatuses to which the respective intake variable openings are connected are not restricted to the above-mentioned kinds. The intake variable openings are adapted to be connected even to other office apparatuses.

The intake variable openings 108*a* to 108*g* are provided with suction ports 109*a* to 109*g*, formed in the housing 172, for passing the air therethrough, and openable and closable doors 111*a* to 111*g* for adjusting the opening amounts of the suction ports 109*a* to 109*g*. Each of the openable and closable doors 111*a* to 111*g* is adapted to be opened and closed at a desired opening and closing angle by a pulse motor (not shown). The openable and closable doors 111*a* to 111*g* and the pulse motor (not shown) together constitute suction opening amount adjusting means. Also, all of the intake variable openings 108*a* to 108*g* in the air processing apparatus 180, according to the present embodiment, have the office apparatuses 73, 74, 103, 51, 52, 104, 72, 53 and 105 connected thereto, but if there is an intake variable opening to which an office apparatus is not connected, that intake variable opening is hermetically sealed by an openable and closable door to thereby enhance the airtightness of the housing.

Inside the suction ports 109*a* to 109*g*, there are provided air speed sensors 112 as suction air flow rate detecting means for detecting the flow speed of the air sucked from the suction ports 109*a* to 109*g*. Also, an openable and closable door 173 for maintenance is openably and closably provided on the back portion 172*e* of the housing 172. The openable and closable door 173 is formed with an exhaust port 171. The exhaust port 171 is covered with a dust collection filter 165 as air processing means for removing dust. This dust collection filter 165 is adapted to be interchangeable by opening the openable and closable door 173. The dust collection filter 165 may be adapted to be detachably mounted from the outside into the exhaust port 171, and be interchangeable without the openable and closable door 173 being opened. Also, instead of the dust collection filter 165, provision may be made of a filter for cleaning the air, such as an ozone removal filter or an odor removal filter. Inside the dust collection filter 165, there is located the exhaust fan 170 provided on the back portion 172*e* of the housing 172.

The exhaust port 171, the dust collection filter 165 and the exhaust fan 170 may be provided in the openable and closable door 173 so as to be opened and closed integrally with the openable and closable door 173. In this case, the maintenance of the interior of the housing 172 can be effected from a portion in which the exhaust fan 170 or the openable and closable door 173 is opened.

The operation of the air processing apparatus will now be described. The controller 120 judges, on the basis of the detecting operations of the connection detecting sensors 106*a* to 106*h*, 106*j*, 106*k* and 106*m*, to which of the interfaces 107*a* to 107*h*, 107*j*, 107*k* and 107*m* are connected the office apparatuses 73, 74, 103, 51, 52, 104, 72, 53 and 105. When, by the operator, color, monochrome, a sheet size, the post-processing of the sheet, the number of image forming sheets, etc., are designated from the operating panel 113 shown in FIG. 1, the controller 120 selects and operates the office apparatuses 73, 74, 51, 52 and 73 known in advance to be connected to the housing 172 by the connection detecting sensors, in accordance with an input signal. The giving and receiving of a signal regarding the control between the controller 120 and the selected office apparatuses is effected through the interfaces 107*a* to 107*h*, 107*j*, 107*k* and 107*m* connected to the selected office apparatuses. Also, the controller 120 actuates the exhaust fan 170. The exhaust fan 170 sucks the air in the selected office apparatuses through the intake variable openings 108*a* to 108*g*.

The air in the paper decks 73 and 74, and the underside panel 105 are sucked from the intake variable opening 108*a* through the side panel 103. Also, the air in the post-processing apparatus 72, and the underside panel 105 are sucked from the intake variable opening 108*f* through the side panel 104. An intake variable opening may be provided in the left side portion 172*a* of the housing 172 so that the air in the paper decks 73 and 74 may be directly sucked into the housing 172 through the intake variable opening. Likewise, an intake variable opening may be provided in the right side portion 172*c* of the housing 172 or the right side of the front portion 172*b* thereof so that the air in the post-processing apparatus 72 may be directly sucked into the housing 172 through the intake variable opening.

The controller 120 calculates the air flow rate sucked from each office apparatus, by the product of the air speed of the air detected by the air speed sensor 112 and the opening and closing angles of the openable and closable doors 111*a* to 111*g* (the opening amounts of the suction ports 109*a* to 109*g*), controls the pulse motor (not shown), and automatically adjusts the opening and closing angles of the openable and closable doors 111*a* to 111*g* to angles at which the air can be sucked at an optimum predetermined air flow rate.

The optimum air flow rate (suction air flow rate) in each office apparatus is stored in the controller 120. The optimum air flow rate is a rate at which no damage is given to each office apparatus or no hindrance is given to the operation thereof and the air in the office apparatuses can be sucked as much as possible to effect the cleaning of the air efficiently. That is, if the air flow rate is too great, there will arise the problems that the wiring in the office apparatuses is sucked and severed to cause short-circuiting, the sheet being conveyed is sucked and the location of the sheet is shifted, and in the image forming apparatus, the toner is sucked to thereby make the toner image unclear or the toner scatters in the image forming apparatus and adheres to other portions to make maintenance difficult to effect. If the air flow rate is made to be small enough so that these problems may not arise, there will arise another problem that the cleaning of the air in the office apparatuses cannot be effected efficiently. So, the optimum air flow rate is set to a rate at which no damage is given to each office apparatus and no hindrance is given to the operation thereof, and the cleaning of the air can be effected efficiently.

The opening and closing angles of the openable and closable doors 111*a* to 111*g* are detected by the pulse number of the pulse motor. The controller 120 may also control the rotating speed of the exhaust fan 170 to thereby adjust the flow rate of the suction air amount.

The air processing apparatus 180 normally detects the air speed by the air speed sensor 112 and, therefore, even when the exhaust resistance of any one of the connected office apparatuses 73, 74, 103, 51, 52, 104, 72, 53 and 105 has changed, the opening and closing angles of the openable and closable doors 111*a* to 111*g* are adjusted, whereby the suction of the air can be effected at an air flow rate optimum to each office apparatus.

Also, when the connected office apparatus has become a discrete apparatus, the air flow rate is adjusted by the above-described construction so as to become an air flow rate according to the connected apparatus. Which apparatus has been connected is inputted, for example, from the top surface panel 102. On the basis of the input information, the flow rate of the air is adjusted by the controller 120 and the openable and closable doors 111*a* to 111*g* (or the exhaust fan 170), which constitute suction air adjusting means.

In this manner, the air processing apparatus 180 according to the first embodiment is adapted to suck the air in the office apparatuses connected to the housing 172 into the housing 172 through the intake variable openings 108*a* to 108*g*, and collectively carry out the process of cleaning the air in the office apparatuses by a single dust collection filter 165.

Therefore, the air processing apparatus 180 can efficiently remove stains caused by the air in the office due to the office apparatuses 73, 74, 103, 51, 52, 104, 72, 53 and 105, and can make the atmospheric environment in the office more comfortable. Particularly, heretofore, even if the stains of the air in the office due to the exhaust air per office apparatus have been slight, the air in the office has been stained by a plurality of office apparatuses gathering, but the air processing apparatus 180 collectively carries out the process of cleaning the exhaust air and, therefore, the efficiency of the air cleaning process can be enhanced to thereby make the atmospheric environment in the office more comfortable.

Moreover, the air processing apparatus 180 is adapted to suck the air in each office apparatus at an air flow rate optimum to each office apparatus and, therefore, can normally keep the interior of each office apparatus in a clean state, and can enable the operation of each office apparatus to be performed smoothly.

Also, the maintenance of the filter heretofore effected for each office apparatus by the user can be accomplished by effecting the maintenance of the single dust collection filter 165 and, thus, the operation of the dust collection filter 165 becomes easy. Further, the maintenance can be effected easily and quickly.

(Air Processing Apparatus According to the Second Embodiment)

The air processing apparatus according to the second embodiment of the present invention will hereinafter be described with reference to FIGS. 5 to 7.

FIG. 5 is a pictorial perspective view of an image forming system 82. The image forming system 82 is formed by a color printer 51 of an electrophotographic printing type, a high-speed monochromatic printer 52 and a high-speed image reading apparatus 53, disposed on a placement stand 54, being connected to the air processing apparatus 280 according to the second embodiment of the present invention. FIG. 6 is a pictorial perspective view of the air processing apparatus 280 according to the second embodiment of the present invention. FIG. 7 is a schematic front cross-sectional view of the air processing apparatus 280 of FIG. 6.

The air processing apparatus 280, according to the second embodiment, as with the air processing apparatus 180, according to the first embodiment, is adapted to collectively clean the air in a plurality of office apparatuses, and then exhaust the air.

The air processing apparatus 280 has, in a housing 275, a controller 220 as controlling means for electrically intensively controlling office apparatuses 52, 51 and 53 connected to the air processing apparatus 280 and the air processing apparatus 280. A controller may be provided for each of the office apparatuses 52, 51 and 53, and the controller 220 may effect the giving and receiving of a signal with the controllers for the office apparatuses 52, 51 and 53 so as to control only the air processing apparatus 280. Also, the giving and receiving of an electrical signal between the controller 220 and the office apparatuses 52, 51, 53, although not shown, is adapted to be effected through an electrical signal interface (not shown) provided in a housing 275, as in the air processing apparatus 180 according to the first embodiment.

The housing 275, constituting an air processing apparatus main body, is provided with an operating panel 213 for operating the image forming system 82, inputting operation information, and displaying the operative state of the image forming system 82.

The housing 275 has an exhaust fan 264 as suction means for sucking and discharging the air in the office apparatuses 52, 51 and 53 connected to the housing 275. The housing 275 is provided with intake variable openings 258*a* to 258*f* constituting a suction air interface. The intake variable openings 258*a* to 258*f* are adapted to be connected to the exhaust ports of the office apparatuses 52, 51 and 53. The air in the office apparatuses 52, 51 and 53 is sucked into the housing 275 by the suction of the exhaust fan 264 through the intake variable openings 258*a* to 258*f*. The intake variable openings 258*a* to 258*f* are adjustable in their opening amounts.

The intake variable opening 258*a*, provided in the right side portion 275*a* of the housing 275, is connected to the image reading apparatus 53 by a connecting duct 256, and the intake variable opening 258*c* is connected to the color printer 51 by a connecting duct 255. In the shown state, nothing is connected to the intake variable opening 258*b*. The intake variable opening 258*e* provided in the left side portion 275*b* of the housing 275 is adapted to be connected to the monochromatic printer 52 by a connecting duct 257. Nothing is connected to the intake variable openings 258*d* and 258*f*. The kinds of the office apparatuses 52, 51 and 53, to which the intake variable openings are connected, are not restricted to the above-mentioned kinds. Other office apparatuses are connected when an image forming system of another form according to the user's necessity is constructed. The intake variable opening 258*a* and the connecting duct 256, the intake variable opening 258*c* and the connecting duct 255, and the intake variable opening 258*e* and the connecting duct 257 together constitute a suction air interface.

The intake variable openings 258*a* to 258*f* are provided with suction ports 249*a* to 249*f*, formed in the housing 275, for passing the air therethrough, and openable and closable doors 248*a* to 248*f* for adjusting the opening amounts of the suction ports 249*a* to 249*f*. The openable and closable doors 248*a* to 248*f* are adapted to be opened and closed at desired opening and closing angles by respective pulse motors (not shown). The openable and closable doors 248*a* to 248*f* and the pulse motors (not shown) together constitute suction opening amount adjusting means.

The intake variable openings 258*a*, 258*c* and 258*e* in the air processing apparatus 280, according to the present embodiment, have the office apparatuses 52, 51 and 53 connected thereto, but the intake variable openings 258*b*, 258*d* and 258*f*, to which the office apparatuses 52, 51 and 53 are not connected, are hermetically sealed by the openable and closable doors 248*b*, 248*d* and 248*f*. Therefore, the airtightness of the housing 275 is enhanced and the interior of the housing is shielded from the exterior.

Inner ducts 259 and 260 guide the air from the intake variable openings 258*a* to 258*f* to a batch processing duct 261. Also, inside the suction ports 249*a* to 249*f*, there are provided air speed sensors 262*a* to 262*f* as suction air flow rate detecting means for detecting the flow speed of the air sucked from the suction ports 249*a* to 249*f*. A variable fin 263 is provided at the joining portion of the inner ducts 259 and 260. This variable fin 263 has its pivotal movement angle adjusted by a pulse motor (not shown) and can adjust the air amount ratio of the inner ducts 259 and 260.

Downstream of the variable fin 263 in the batch processing duct 261, there are provided a dust collection filter 265, an ozone removal filter 266 and an odor removal filter 267 as air processing means, and an exhaust fan 264 at a slight distance therefrom. The housing 275 is provided with an openable and closable door 268 (see FIGS. 5 and 6). When the openable and closable door 268 is opened, the maintenance of the filters 265, 266, 267, the exhaust fan 264, etc., in the housing 275, can be effected. Not all of the filters need always be provided. At least one filter may be provided. Also, instead of the filters, provision may be made of a heat processing device, such as a heat exchanger or a cooling device for lowering the temperature of the air. An exhaust port 270 having a dust-proof cover 269 is formed at a portion whereat the batch processing duct 261 is connected to the housing 275.

The air processing apparatus 280 according to the present embodiment, as with the air processing apparatus 180 according to the first embodiment, may be provided with connection detecting sensors for detecting whether the office apparatuses 52, 51 and 53 are connected to the intake variable openings 258*a* to 258*f* in the intake variable openings 258*a* to 258*f*.

The operation of the air processing apparatus 280 will now be described. When, by the operator, color, monochrome, a sheet size, the post-processing of the sheet, the number of image forming sheets, etc., are designated from the operating panel 213, the office apparatuses 52, 51 and 53 are operated in accordance with an input signal. The giving and receiving of a signal regarding control between the controller 220 and the office apparatuses 52, 51 and 53 is effected through an electrical signal interface (not shown). Also, the controller 220 actuates the exhaust fan 264. The exhaust fan 264 sucks the air in the office apparatuses 52, 51 and 53 through the intake variable openings 258*a*, 258*c* and 258*e*.

Then, the controller 220 calculates the air flow rates sucked from the respective office apparatuses, by the product of the air speed of the air detected by the air speed sensors 262*a*, 262*c* and 262*e*, and the opening and closing angles of the openable and closable doors 248*a*, 248*c* and 248*e* (the opening amounts of the suction ports 249*a*, 249*c* and 249*e*), controls the pulse motor (not shown), and automatically adjusts the opening and closing angles of the openable and closable doors 248*a*, 248*c* and 248*e* and the rotation angle of the variable fin 263 to angles at which the air can be sucked at an optimum air flow rate. The opening and closing angles of the openable and closable doors 248*a*, 248*c* and 248*e* are detected by the pulse number of the pulse motor.

The air processing apparatus 280 normally detects the air speed by the air speed sensors 262*a*, 262*c* and 262*e* and, therefore, even when the exhaust resistance of any one of the connected office apparatuses 52, 51 and 53 has changed, the opening and closing angles of the openable and closable doors 248*a*, 248*c* and 248*e* can be adjusted to thereby effect the suction of the air at an air flow rate optimum to each office apparatus.

In this manner, the air processing apparatus 280, according to the second embodiment, is adapted to suck the air in the office apparatuses 52, 51 and 53, carry out the process of collectively cleaning the air by the various filters 265, 266 and 267, and discharge the air as comfortable air having little dust, ozone and odor (particularly, electron odor) from the discharge port 70.

Therefore, the air processing apparatus 280 according to the second embodiment, as in the air processing apparatus 180 according to the first embodiment, can also achieve the following effects.

The stains of the air in the office due to the office apparatuses can be removed efficiently, and the atmospheric environment in the office can be made comfortable. The efficiency of the air cleaning process can be enhanced to thereby make the atmospheric environment in the office more comfortable.

The interior of each office apparatus can be normally kept in a clean state so that the operation of each office apparatus can be performed smoothly.

Also, the air processing apparatus 280, according to the second embodiment, enables the maintenance of the various filters 265, 266 and 267 to be collectively effected by opening the openable and closable door 268. Consequently, the maintenance can be effected easily and quickly.

In the present second embodiment, as the office apparatus, there is shown a form in which the color printer 51, the monochromatic printer 52 and the image reading apparatus 53 are connected to the housing. However, a paper deck, a recording paper conveying apparatus, a post-processing apparatus, a signal input apparatus, etc., can be selectively connected to the housing 275.

(Air Processing Apparatus According to the Third Embodiment)

The air processing apparatus according to the third embodiment of the present invention will hereinafter be described with reference to FIGS. 8 and 9.

FIG. 8 is a pictorial perspective view of an image forming system 83. The image forming system 83 is formed by a color printer 51 of an electrophotographic printing type and an image reading apparatus 53 disposed on a placement stand 54 being connected to the air processing apparatus 380 according to the third embodiment of the present invention. FIG. 9 is a schematic front cross-sectional view of the air processing apparatus of FIG. 8.

The air processing apparatus 380, according to the third embodiment, collectively subjects the air in a plurality of office apparatuses to the cleaning process and the heat radiating process, and then sends the air again into the office apparatuses, thus circulating and using the air.

The air processing apparatus 380 is constituted by an intake portion 381 for sucking and cleaning the air in the office apparatuses 51 and 53 connected to the air processing apparatus 380, a heat exchange duct 395 for subjecting the air cleaned by the intake portion 381 to the heat radiating process to thereby lower the temperature of the air, and an air blowing portion 382 for supplying the air lowered in temperature by the heat exchange duct 395 into the office apparatuses 51 and 53.

The air processing apparatus 380 has, in a housing 375, a controller 320 as a control portion for electrically intensively controlling the office apparatuses 51 and 53 connected to the air processing apparatus 380 and the air processing apparatus 380. The housing 375, constituting the apparatus main body of the air processing apparatus 380, is formed by the housing 371 of the intake portion 381, the heat exchange duct 395 and the housing 372 of the air blowing portion 382 being connected thereto. A controller may be provided for each of the office apparatuses 51 and 53, and the controller 320 may be adapted to effect the giving and receiving of a signal with the office apparatuses 51 and 53, and control only the air processing apparatus 380.

Also, the giving and receiving of an electrical signal between the controller 320 and the office apparatuses 51, 53, although not shown, is effected through an electrical signal interface (not shown) provided in the housing 375, as in the air processing apparatus 180 according to the first embodiment.

The heat exchange duct 395 is provided with an operating panel 313 in a top plate portion 383 through an adiabatic material (not shown). The operating panel 313 is a portion for the operator to operate the image forming system 83, and to input operation information. Also, the operating panel 313 is a portion for displaying the operative state of the image forming system 83.

The housing 371 has an exhaust fan 364 as suction means. The exhaust fan 364 sucks the air in the office apparatuses 51 and 53 connected to the housing 371, and sends the air to the air blowing portion 382 through the heat exchange duct 395. In the right side portion 371*a* of the housing 371, there are provided intake variable openings 384*a*, 384*b* and 384*c* constituting a suction air interface. The intake variable openings 384*a* and 384*c* are connected to the image reading apparatus 53 and the exhaust port of the color printer 51 through connecting ducts 386 and 387. In the present embodiment, there is shown a construction in which nothing is connected to the intake variable opening 384*b*. The kinds of the office apparatuses connected to the intake variable openings 384*a*, 384*b* and 384*c* are not restricted to the above-mentioned kinds. Even other office apparatuses are connected. The intake variable opening 384*a* and the connecting duct 386, and the intake variable opening 384*c* and the connecting duct 387 constitute suction air interfaces.

The air in the office apparatuses 51 and 53 is sucked into the housing 371 by the suction of the exhaust fan 364 through the intake variable openings 384*a* and 384*c*. The intake variable openings 384*a* and 384*c* can have their opening amounts adjusted.

The intake variable openings 384*a*, 384*b* and 384*c* are provided with suction ports 396*a*, 396*b* and 396*c* formed in the housing 371 for passing the air therethrough, and openable and closable doors 398*a*, 398*b* and 398*c* for adjusting the opening amounts of the suction ports 396*a*, 396*b* and 396*c*. The openable and closable doors 398*a*, 398*b* and 398*c* are opened and closed at desired opening and closing angles by pulse motors (not shown). The openable and closable doors 398*a*, 398*b* and 398*c* and the pulse motors (not shown) together constitute suction opening amount adjusting means.

The intake variable openings 384*a* and 384*c* in the air processing apparatus 380 according to the present embodiment have the office apparatuses 53 and 51 connected thereto, but the intake variable opening 384*b*, to which the office apparatuses 53 and 51 are not connected, is hermetically sealed by the openable and closable door 398*b*. Therefore, the air tightness of the housings 371 and 375 is enhanced, and the interiors of these housings are shielded from the exterior.

Inside the suction ports 396*a*, 396*b* and 396*c*, there are provided air speed sensors 393*a*, 393*b* and 393*c* as suction air flow rate detecting means for detecting the flow speed of the sucked air.

A batch processing duct 390 guides the air from the suction ports 396*a*, 396*b* and 396*c*. In the batch processing duct 390, there are provided, in succession from an upstream side to a downstream side, a dust collection filter 365, an ozone removal filter 366 and an odor removal filter 367 as air processing means, and an exhaust fan 364 at a slight distance therefrom. The housing 371 is provided with an openable and closable door 368 (see FIG. 8). When the openable and closable door 368 is opened, the maintenance of the filters 365, 366 and 367, the exhaust fan 364, etc., in the housing 375 can be effected. Not all of the filters need always be provided. At least one filter may be provided.

The heat exchange duct 395 guides the air from the batch processing duct 390 of the intake portion 381 to the air blowing duct 391 of the air blowing portion 382. The heat exchange duct 395 is covered with a top plate portion 383 as a heat radiating plate. A metal material of good thermal conductivity is used for the top plate portion 383. The top plate portion 383 has a wide area and diffuses the heat of the clean air sent from the batch processing duct 390 of the intake portion 381 while it passes through the heat exchange duct 395. This air lowered in its temperature is sent to the air blowing duct 391 of the air blowing portion 382 and, therefore, is utilized as cooling air for the office apparatuses 53 and 51.

An air blowing fan 392, as a supplying means, is provided in the air blowing duct 391 of the air blowing portion 382. The air blowing fan 392 supplies the cooling air sent from the heat exchange duct 395 to the office apparatuses 53 and 51 at an optimum air flow rate.

In the left side portion 372*a* of the housing 372 of the air blowing portion 382, there are provided air blowing variable openings 385*a*, 385*b* and 385*c* constituting a supply air interface. The air blowing variable opening 385*a* is connected to the inflow port of the image reading apparatus 53 by a connecting duct 389, and the air blowing variable opening 385*c* is connected to the inflow port of the color printer 51 by a connecting duct 388. In the present embodiment, there is shown a construction in which nothing is connected to the air blowing variable opening 385*b*. The air in the housing 372 is supplied into the office apparatuses 51 and 53 by the air blowing fan 392 through the air blowing variable openings 385*a* and 385*c*. The air blowing variable opening 385*a* and the connecting duct 389, and the air blowing variable opening 385*c* and the connecting duct 388 together constitute a supply air interface.

The kinds of office apparatuses connected to the air blowing variable openings 385*a*, 385*b* and 385*c* are not restricted to the above-mentioned kinds. Even other office apparatuses are connected.

The opening amounts of the air blowing variable openings 385*a*, 385*b* and 385*c* can be adjusted. The air blowing variable openings 385*a*, 385*b* and 385*c* are provided with air blowing ports 397*a*, 397*b* and 397*c* as supply ports formed in the housing 372 for passing the air therethrough, and openable and closable doors 399*a*, 399*b* and 399*c* for adjusting the opening amounts of the air blowing ports 397*a*, 397*b* and 397*c*. The openable and closable doors 399*a*, 399*b* and 399*c* are opened and closed so as to assume desired opening and closing angles by pulse motors (not shown). The pulse motors (not shown) for the openable and closable doors 399*a*, 399*b* and 399*c* constitute supply opening amount adjusting means.

The air blowing variable openings 385*a* and 385*c* in the air processing apparatus 380 according to the present embodiment have the office apparatuses 53 and 51 connected thereto, but the air blowing variable opening 385*b*, to which the office apparatuses 53 and 51 are not connected, is hermetically sealed by the openable and closable door 399*b*. Therefore, the airtightness of the housings 372 and 375 is enhanced, and the interior of these housings is shielded from the exterior.

Inside the air blowing ports 397*a*, 397*b* and 397*c*, there are provided air speed sensors 394*a*, 394*b* and 394*c* as supply air flow rate detecting means for detecting the flow speed of the air sucked from the air blowing variable openings 397*a*, 397*b* and 397*c*.

In the air processing apparatus 380 according to the present embodiment, as in the air processing apparatus 180, according to the first embodiment, connection detecting sensors as suction connection detecting means and supply connection detecting means for detecting whether the office apparatuses 53 and 51 are connected to the intake variable openings 384*a*, 384*b*, 384*c* and the air blowing variable openings 385*a*, 385*b*, 385*c* may be provided in the intake variable openings 384*a*, 384*b*, 384*c* and the air blowing variable openings 385*a*, 385*b*, 385*c*.

The operation of the air processing apparatus 380 will now be described. When, by the operator, color, a sheet size, the number of image forming sheets, etc., are designated from an operating panel 313, the controller 320 actuates the office apparatuses 53 and 51 in accordance with an input signal. The giving and receiving of a signal regarding control between the controller 320 and the office apparatuses 53, 51 is effected through an electrical signal interface (not shown). Also, the controller 320 actuates the exhaust fan 364 and the air blowing fan 392. The exhaust fan 364 sucks the air in the office apparatuses 53 and 51 through the intake variable openings 384*a* and 384*c*. The air blowing fan 392 supplies the air sent from the intake portion 381 through the heat exchange duct 395 into the office apparatuses 53 and 51 through the air blowing variable openings 385*a* and 385*c*.

Then, the controller 320 calculates the sucked air amount by the product of the air speed of the air detected by the air speed sensors 393*a* and 393*c* and the opening and closing angles of the openable and closable doors 398*a* and 398*c* (the opening amounts of the air blowing ports 397*a* and 397*c*), controls the pulse motor (not shown), and adjusts the opening and closing angles of the openable and closable doors 398*a* and 398*c*. Also, the controller 320 calculates the supplied air amount by the product of the air speed of the air detected by the air speed sensors 394*a* and 394*c* and the opening and closing angles of the openable and closable doors 399*a* and 399*c* (the opening amounts of the air blowing ports 397*a* and 397*c*), controls the pulse motor (not shown), and adjusts the opening and closing angles of the openable and closable doors 399*a* and 399*c*. The opening and closing angles of the openable and closable doors 398*a*, 398*c*, 399*a* and 399*c* are detected by the pulse number of the pulse motor. The controller 320 may control the rotating speeds of the exhaust fan 364 the air blowing fan 392 to thereby adjust the suction air flow rate and the supply air flow rate.

An optimum supply air flow rate for each office apparatus is stored in the controller 120. The optimum supply air flow rate is a rate at which no damage is given to each office apparatus and no hindrance is given to the operation thereof, and the cleaning of the air in the office apparatuses can be effected efficiently. That is, if the supply air flow rate is too great, there will arise the problems that the wiring in the office apparatuses is blown off and severed or short-circuited, the sheet being conveyed is floated up, and in the image forming apparatus, the toner is scattered to thereby make the toner image unclear, and the scattered toner adheres to other portions in the image forming apparatus to thereby make maintenance difficult to effect. If the supply air flow rate is made small so that these problems may not arise, there will arise another problem that the cleaning of the air in the office apparatuses cannot be effected efficiently. So, the optimum supply air flow rate is set to a rate at which no damage is given to each office apparatus and no hindrance is given to the operation thereof, and the cleaning of the air can be effected efficiently.

As described above, the controller 320 adjusts the opening and closing angles of the openable and closable doors 398*a* and 398*c* so as to bring about the suction air flow rate stored for each office apparatus, and also adjusts the opening and closing angles of the openable and closable doors 399*a* and 399*c* so as to bring about the supply air flow rate stored for each office apparatus and, therefore, the air processing apparatus 380 can quickly and efficiently circulate the air in the office apparatuses 53 and 51. That is, when the connected office apparatus becomes a discrete apparatus, the air flow rate is adjusted by the above-described construction so as to be an air flow rate according to the connected office apparatus. Which apparatus has been connected is inputted, for example, from the operating panel 313. On the basis of the input information, the flow rate of the air is adjusted by the controller 320 and the openable and closable door 398*a* (or the exhaust fan 364) constituting suction air adjusting means. Also, on the basis of the input information, the controller 320 and the openable and closable door 399*a* (or the air blowing fan 392), constituting supply air adjusting means, are activated.

The air speed is normally detected by the air speed sensors 393*a*, 393*c*, 394*a* and 394*c* and, therefore, even when the exhaust resistance and supply resistance of any one of the connected office apparatuses 53 and 51 have changed, the air processing apparatus 380 can always detect the air amount and can effect the optimum suction and supply of the air.

In this manner, the air processing apparatus 380, according to the third embodiment, carries out the process of cleaning the air in the office apparatuses to thereby decrease dust, ozone, odor (particularly electron odor), etc., by the various filters, and further carries out the heat radiating process and sends the air again into the office apparatuses, thus circulating and using the air.

Therefore, the air processing apparatus 380 according to the third embodiment can prevent the dust, ozone and odor generated from the office apparatuses and the operation sounds of the office apparatuses and the fan from leaking to the outside. Even if the air leaks, the air has been subjected to the cleaning process and the heat radiating process and, therefore, hardly adversely affects the outside. As the result, the atmospheric environment in the office becomes comfortable.

Further, the air processing apparatus 380, according to the third embodiment, as with the air processing apparatus 180 according to the first embodiment, can also keep the interior of each office apparatus in a clean state, and enables the operation of each office apparatus to be performed smoothly.

Also, the air processing apparatus 380, according to the third embodiment, as with the air processing apparatus 280 according to the second embodiment, can collectively effect the maintenance of the various filters 365, 366 and 367 with the openable and closable door 368 opened. Consequently, the maintenance can be effected easily and quickly.

Each of the above-described air processing apparatuses 180, 280 and 380 is connected to each office apparatus by an electrical interface, but may be directly electrically connected to the latter by electrical wiring without the use of the interface.

In the third embodiment, as the office apparatus, there has been shown a form in which the color printer 51 and the image reading apparatus 53 are connected to the air processing apparatus 380. However, a paper deck, a recording paper conveying apparatus, a post-processing apparatus, a signal inputting apparatus, a discrete printer, etc., can be selectively connectable to the air processing apparatus 380.

What is claimed is:

1. An air processing apparatus comprising:

an air processing apparatus main body to which an office apparatus is connectable;

a suction air interface configured to connect the office apparatus and said air processing apparatus main body together in such a manner that air in the office apparatus can be received into said air processing apparatus main body;

air processing means provided in said air processing apparatus main body for effecting processing on air received into said air processing apparatus main body through said suction air interface;

a control portion configured to control the office apparatus connected to said air processing apparatus main body and provided in said air processing apparatus main body; and an electrical signal interface provided between the office apparatus connected to said air processing apparatus main body and said air processing apparatus main body for effecting the giving and receiving of an electrical signal between the office apparatus and said control portion.

2. An air processing apparatus according to claim 1, wherein said air processing means is provided with at least one of a dust collection filter for removing dust, an ozone removal filter for removing ozone, and an odor removal filter for removing odor.

3. An air processing apparatus according to claim 1, wherein said air processing means is provided with heat radiating means for radiating air heat.

4. An air processing apparatus according to claim 1, wherein said air processing apparatus main body is connectable to a plurality of office apparatuses, including an image forming apparatus for forming an image on a sheet.

5. An air processing apparatus according to claim 4, wherein office apparatuses of different kinds are connectable to said air processing apparatus main body, said air processing apparatus further comprises suction air flow rate adjusting means for adjusting a flow rate of air sucked from the office apparatuses into said air processing apparatus main body, and said suction air flow rate adjusting means adjusts the flow rate of the air sucked according to the kind of the office apparatuses connected to said air processing apparatus.

6. An air processing apparatus according to claim 4, wherein, as the plurality of office apparatuses, at least two of an image reading apparatus for reading an image of an original, a recording paper feeding apparatus for feeding a sheet on which the image is formed by said image forming apparatus, and a sheet processing apparatus for effecting processing on the sheet on which the image has been formed, are selectively connectable to said air processing apparatus main body.

7. An air processing apparatus according to claim 1, further comprising a suction fan for sucking air in the office apparatus into said air processing apparatus main body through said suction air interface.

8. An air processing apparatus according to claim 7, further comprising suction air flow rate detecting means for detecting a flow rate of air sucked from the office apparatus by said suction fan, wherein said control portion controls said suction fan on the basis of a detection by said suction air flow rate detecting means so that the flow rate of the air sucked may be a predetermined flow rate.

9. An air processing apparatus according to claim 7, further comprising suction air flow rate detecting means for detecting the flow rate of the air sucked from the office apparatus by said suction fan, said suction air interface having a suction port through which air passes, and an openable and closable door moved so as to adjust an opening amount of said suction port, wherein said control portion controls a movement of said openable and closable door on the basis of a detection by said suction air flow rate detecting means, so that the flow rate of the air sucked may be a predetermined flow rate.

10. An air processing apparatus according to claim 1, further comprising a supply air interface for connecting the office apparatus and said air processing apparatus main body together, so that air processed by said air processing apparatus main body can be supplied into the office apparatus.

11. An air processing apparatus according to claim 10, further comprising a supplying fan for supplying air processed by said air processing apparatus main body into the office apparatus through said supply air interface.

12. An image forming system comprising:

an air processing apparatus as recited in claim 1; and a plurality of image forming apparatuses connected as the office apparatus to an air processing apparatus main body for forming images on sheets.

13. An image forming system comprising:

an air processing apparatus as recited in claim 1;

a recording paper feeding apparatus for feeding a sheet;

a first recording paper conveying apparatus for conveying the sheet fed by said recording paper feeding apparatus;

an image forming apparatus for forming an image on the sheet conveyed by said first recording paper conveying apparatus;

a second recording paper conveying apparatus for conveying the sheet on which the image has been formed by said image forming apparatus; and a sheet processing apparatus for effecting processing on the sheet conveyed by said second recording paper conveying apparatus, wherein said recording paper feeding apparatus is disposed on one side of said image forming apparatus through said first recording paper conveying apparatus, and said sheet processing apparatus is disposed on the other side of said image forming apparatus through said second recording paper conveying apparatus, and at least two of said first recording paper conveying apparatus, said image forming apparatus, said second recording paper conveying apparatus and said sheet processing apparatus, are connected as the office apparatus to said air processing apparatus main body behind said at least two apparatuses.

14. An image forming system according to claim 13, further comprising a second image forming apparatus provided above said image forming apparatus, between said first recording paper conveying apparatus and said second recording paper conveying apparatus, for forming an image on the sheet conveyed by said first recording paper conveying apparatus and feeding the sheet on which the image has been formed to said second recording paper conveying apparatus, wherein said second image forming apparatus is connected as the office apparatus to said air processing apparatus main body.

15. An air processing apparatus comprising:

an air processing apparatus main body to which an office apparatus is connectable;

a suction air interface configured to connect the office apparatus and said air processing apparatus main body together in such a manner that air in the office apparatus can be received into said air processing apparatus main body;

air processing means provided in said air processing apparatus main body for effecting processing on air received into said air processing apparatus main body through said suction air interface;

a suction fan for sucking air in the office apparatus into said air processing apparatus main body through said suction air interface;

suction air flow rate detecting means for detecting a flow rate of air sucked from the office apparatus by said suction fan;

a suction port, provide on said suction air interface, through which air passes;

an openable and closable door moved so as to adjust an opening amount of said suction port; and a control portion configured to control a movement of said openable and closable door on the basis of a detection by said suction air flow rate detecting means, so that the flow rate of the air sucked may be a predetermined flow rate.

16. An air processing apparatus according to claim 15, wherein said control portion is provided in said air processing apparatus main body.

17. An air processing apparatus comprising:

an air processing apparatus main body to which a plurality of office apparatuses, including an image forming apparatus for forming an image on a sheet, are connectable;

a suction air interface configured to connect the plurality of office apparatuses and said air processing apparatus main body together in such a manner that air in the plurality of office apparatuses can be received into said air processing apparatus main body;

air processing means provided in said air processing apparatus main body for effecting processing on air received into said air processing apparatus main body through said suction air interface; and suction air flow rate adjusting means for adjusting a flow rate of air sucked from the office apparatuses into said air processing apparatus main body and adjusting the flow rate of the air sucked according to the kind of the office apparatuses connected to said air processing apparatus, wherein office apparatuses of different kinds are connectable to said air processing apparatus main body.

* * * * *